US008282433B2

(12) United States Patent
Lavagna

(10) Patent No.: US 8,282,433 B2
(45) Date of Patent: Oct. 9, 2012

(54) BUOY-TO-RISER CONNECTOR

(75) Inventor: Philippe Daniel Richard Lavagna, Katy, TX (US)

(73) Assignee: Seahorse Equipment Corp., Houston, TX (US)

( * ) Notice: Subject to any disclaimer, the term of this patent is extended or adjusted under 35 U.S.C. 154(b) by 169 days.

(21) Appl. No.: 12/777,921

(22) Filed: May 11, 2010

(65) Prior Publication Data

US 2010/0285709 A1 Nov. 11, 2010

Related U.S. Application Data

(60) Provisional application No. 61/177,169, filed on May 11, 2009.

(51) Int. Cl.
*B63B 22/02* (2006.01)

(52) U.S. Cl. ..... 441/4; 405/224.3

(58) Field of Classification Search ..... 441/3, 4, 441/5; 405/195.1, 224.2, 224.3, 224.4
See application file for complete search history.

(56) References Cited

U.S. PATENT DOCUMENTS

| | | | | |
|---|---|---|---|---|
| 4,279,047 | A * | 7/1981 | van Heijst | 441/5 |
| 4,279,543 | A * | 7/1981 | Remery | 405/224.3 |
| 5,269,629 | A * | 12/1993 | Langner | 405/195.1 |
| 6,109,989 | A * | 8/2000 | Kelm et al. | 441/4 |
| 6,558,215 | B1 * | 5/2003 | Boatman | 441/5 |
| 6,763,862 | B2 * | 7/2004 | Fontenot et al. | 441/5 |
| 2009/0186538 | A1 * | 7/2009 | Wille et al. | 441/4 |

* cited by examiner

*Primary Examiner* — Lars A Olson
(74) *Attorney, Agent, or Firm* — Wong, Cabello, Lutsch, Rutherford & Brucculeri, L.L.P.

(57) ABSTRACT

A support for a subsea riser decouples the function of the riser into two separate functions: the load transfer function which supports the hung weight of a subsea riser configuration to a supporting floater (such as the buoy of a disconnectable fluid transfer system) and the fluid transfer function which provides a continuous flow path for the fluid coming to or from the riser.

17 Claims, 2 Drawing Sheets

BUOY-TO-RISER CONNECTOR

CROSS-REFERENCE TO RELATED APPLICATIONS

This application claims the benefit of U.S. Provisional Application No. 61/177,169 filed May 11, 2009.

STATEMENT REGARDING FEDERALLY SPONSORED RESEARCH OR DEVELOPMENT

Not Applicable

BACKGROUND OF THE INVENTION

1. Field of the Invention

This invention relates to hydrocarbon transfer apparatus. More particularly, it relates to connection means between mooring buoys and steel catenary risers.

2. Description of the Related Art Including Information Disclosed Under 37 CFR 1.97 and 1.98.

U.S. Patent Publication No. 2004/0077234 describes a wave motion absorbing offloading system in which a floating construction such as an FPSO is connected to an offloading buoy via a submerged offloading pipeline. The motions of the buoy are de-coupled form the pipeline via connection of the pipeline by a support member and connecting member while the pipeline is extendable in a length direction to compensate for drift phenomena.

BRIEF SUMMARY OF THE INVENTION

The practice of the present invention permits one to decouple the function of the riser into two separate functions: 1) the load transfer function which supports the hung weight of the riser configuration to the supporting floater (such as, but not limited to, the buoy of a disconnectable system); and, 2) the fluid transfer function which provides a continuous flow path for the fluid coming from/to the riser.

BRIEF DESCRIPTION OF THE SEVERAL VIEWS OF THE DRAWING(S)

DETAILED DESCRIPTION OF THE INVENTION

Figure 1:
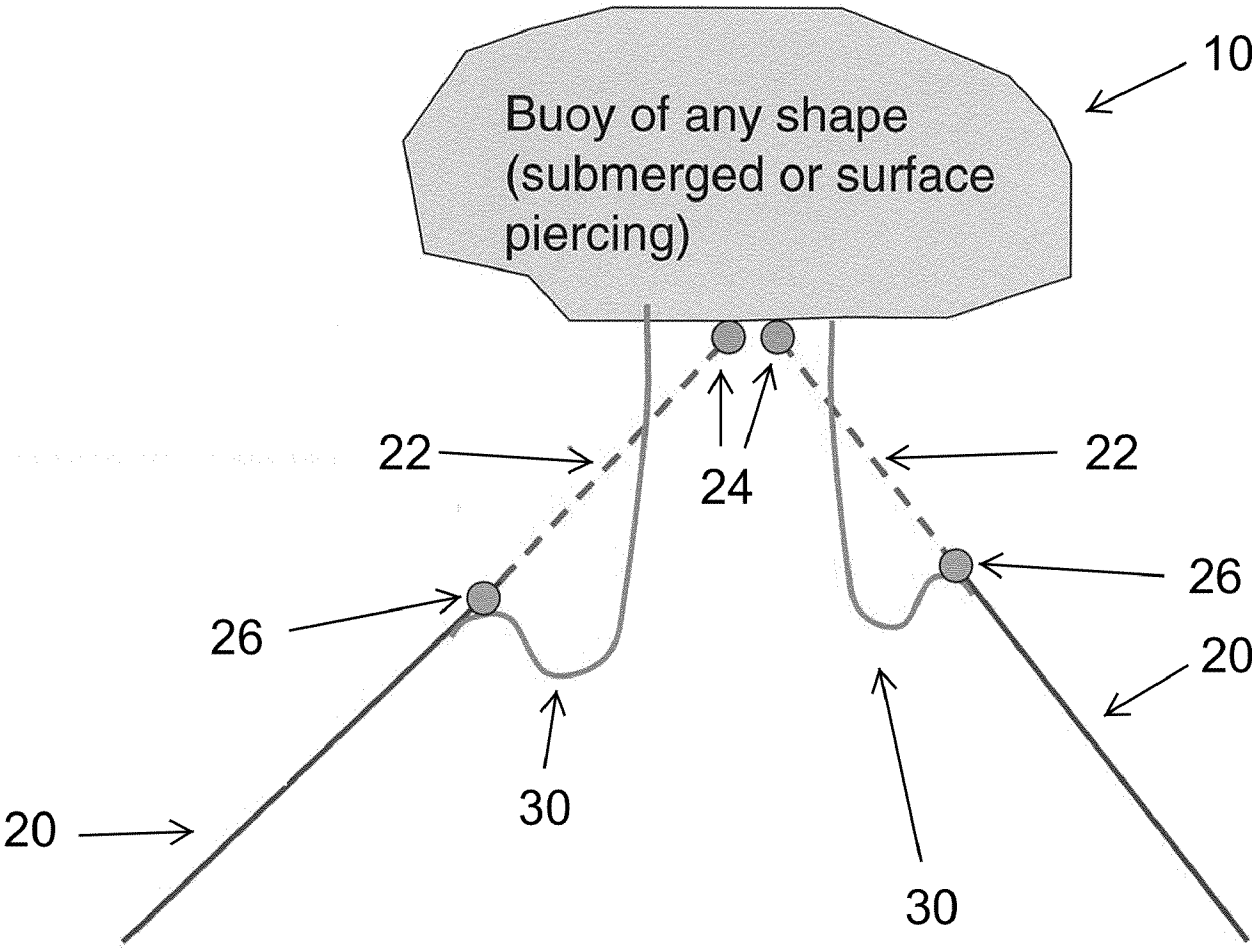
FIG. 1 is a diagram of a connection of a stiff riser to a buoy.

Risers (such as but not limited to: Steel Catenary Risers, Lazy Wave Steel Catenary Risers, or high pressure or large diameter flexible risers) may lead to large bending and tension loads which can affect the behavior of a buoy (such as but not limited to the buoy of a disconnectable mooring system.

The present invention decouples the function of the riser into two separate functions: the load transfer function which provides support for the hung weight of the riser configuration to the supporting floater (such as, but not limited to, the buoy of a disconnectable system) and the fluid transfer function which provides a continuous flow path for the fluid coming from/to the riser The load transfer function is provided by a load carrying member (such as, but not limited to: chain, wire rope, synthetic rope, steel arm, and the like) which connects the riser to the buoy via an articulation at both ends to remove most of the bending at both extremities of the load carrying member.

The fluid transfer function may be provided by a flexible pipe or hose string (depending on the application), called herein below "flexible jumper."

The length of the flexible jumper and of the load carrying member may be optimized for each application, considering objectives such as but not limited to: improving the fatigue life of the risers and/or other components of the buoy; reducing extreme loads (such as, but not limited to, bending loads); allowing for larger operating conditions (such as but not limited to: high current, high sea states); improving the balance of forces from the riser system on the buoy and therefore reducing or avoiding the need for ballast; in the case of disconnectable systems (such as, but not limited to, internal turrets), enabling the flexible jumper to be routed through or around the mooring buoy up to the main deck of the moored larger floater.

The invention may best be understood by reference to certain illustrative embodiments which are shown in the drawing figures.

Referring now to FIG. 1, buoy 10 may be a buoy of any shape or configuration. Buoy 10 may be a submerged buoy or a surface-piercing buoy. Risers 20 may be steel catenary risers (SCR's), HP or large diameter, flexible risers or any other type of subsea riser needing support on or near its upper end. Articulations 26 provide a mechanical connection between riser 20 and load carrying member 22 which may comprise chain, wire, synthetic rope or a rigid arm. At the opposing end of load carrying member 22, articulation 24 provides a mechanical connection to buoy 10. Articulations 24 and 26 may comprise shackles, Uni-Joints, elastomeric joints, gimbal tables, and the like. Fluid transfer from riser 20 to buoy 10 may be via flexible conduit 30 which may comprise a flexible jumper, pipe or hose string.

Figure 2:
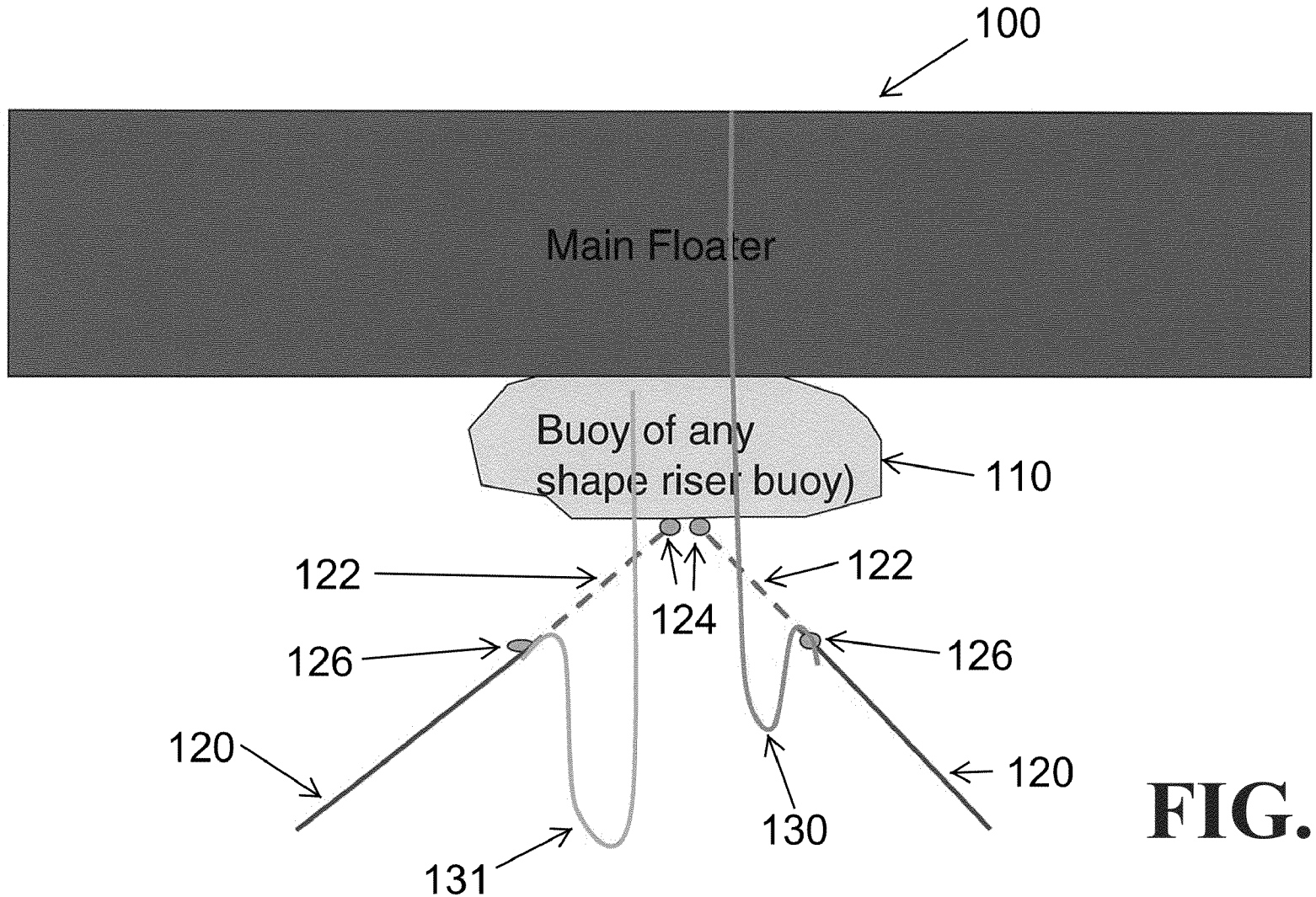
FIG. 2 is a diagram of a disconnectable system according to an embodiment of the invention.

A disconnectable system according to the invention is illustrated in FIG. 2. Main floater 100 may be moored to or proximate buoy 110. Buoy 110 may be a submerged buoy or a surface-piercing buoy. Risers 120 may be steel catenary risers (SCR's), HP or large diameter, flexible risers or any other type of subsea riser needing support on or near its upper end. Articulations 126 provide a mechanical connection between risers 120 and load carrying members 122 which may comprise chain, wire, synthetic rope or a rigid arm. At the opposing end of load carrying member 122, articulation 124 provides a mechanical connection to buoy 110. Articulations 124 and 126 may comprise shackles, Uni-Joints, elastomeric joints, gimbal tables, and the like. Fluid transfer from riser 120 to floater 100 may be via flexible conduit 130 which may comprise a flexible jumper, pipe or hose string. Flexible jumper 130 in FIG. 2 is shown in connected mode with a fluid connection at the main deck of floater 100. Flexible jumper 131 in FIG. 2 depicts a jumper prior to disconnection. The upper end of jumper 131 may be supported on buoy 110 when floater 100 is not present.

Although the invention has been described in detail with reference to certain preferred embodiments, variations and modifications exist within the scope and spirit of the invention as described and defined in the following claims.

What is claimed is:

1. A riser support comprising:

a buoy;

a first articulation connected to the buoy wherein said first articulation is selected from the group consisting of uni-joints, elastomeric joints and gimbal tables;

a non-fluid-carrying, load-carrying member having a first end connected to the buoy via the first articulation and an opposing second end;

a second articulation connected to the second end of the load-carrying member and having means for attachment to a riser; and, a flexible conduit connected at a first end to the buoy and having an opposing second end with means for fluid connection to a subsea riser attached to the second articulation.

2. A riser support as recited in claim 1 wherein the buoy is a sub-surface buoy.

3. A riser support as recited in claim 1 wherein the buoy is a surface buoy.

4. A riser support as recited in claim 1 wherein the first articulation comprises a shackle.

5. A riser support as recited in claim 1 wherein the load-carrying member comprises chain.

6. A riser support as recited in claim 1 wherein the load-carrying member comprises wire cable.

7. A riser support as recited in claim 1 wherein the load-carrying member comprises synthetic rope.

8. A fluid transfer system comprising:

a buoy;

a subsea riser;

a first articulation connected to the buoy wherein said first articulation is selected from the group consisting of uni-joints, elastomeric joints, and gimbal tables;

a non-fluid-carrying, load-carrying member having a first end connected to the buoy via the first articulation and an opposing second end;

a second articulation connected to the second end of the load-carrying member and to the riser; and, a flexible conduit connected at a first end to the buoy and having an opposing second end in fluid communication with the subsea riser.

9. A fluid transfer system as recited in claim 8 wherein the buoy is a sub-surface buoy.

10. A fluid transfer system as recited in claim 8 wherein the first articulation comprises a shackle.

11. A fluid transfer system as recited in claim 8 wherein the load-carrying member comprises chain.

12. A fluid transfer system as recited in claim 8 wherein the load-carrying member comprises wire cable.

13. A fluid transfer system as recited in claim 8 wherein the load-carrying member comprises synthetic rope.

14. A fluid transfer system as recited in claim 8 wherein the riser is a steel catenary riser.

15. A fluid transfer system as recited in claim 12 wherein the buoy is a surface buoy.

16. A riser support comprising:

a buoy;

a first articulation connected to the buoy;

a non-fluid-carrying, load-carrying member comprising a rigid arm and having a first end connected to the buoy via the first articulation and an opposing second end;

a second articulation connected to the second end of the load-carrying member and having means for attachment to a riser; and, a flexible conduit connected at a first end to the buoy and having an opposing second end with means for fluid connection to a subsea riser attached to the second articulation.

17. A fluid transfer system comprising:

a buoy;

a subsea riser;

a first articulation connected to the buoy;

a non-fluid-carrying, load-carrying member comprising a rigid arm and having a first end connected to the buoy via the first articulation and an opposing second end;

a second articulation connected to the second end of the load-carrying member and to the riser; and, a flexible conduit connected at a first end to the buoy and having an opposing second end in fluid communication with the subsea riser.

* * * * *